United States Patent [19]

Lutz

[11] 4,391,048

[45] Jul. 5, 1983

[54] ELASTIC SOLE FOR A SHOE INCORPORATING A SPRING MEMBER

[75] Inventor: Dieter Lutz, Schweinfurt, Fed. Rep. of Germany

[73] Assignee: Sachs- Systemtechnik GmbH, Schweinfurt, Fed. Rep. of Germany

[21] Appl. No.: 217,037

[22] Filed: Dec. 16, 1980

[30] Foreign Application Priority Data

Dec. 21, 1979 [DE] Fed. Rep. of Germany ..... 2951572

[51] Int. Cl.[3] ..... A43B 13/18; A43B 21/26

[52] U.S. Cl. ..... 36/28; 36/30 R; 36/35 R; 36/37

[58] Field of Search ..... 36/28, 29, 27, 30 R, 36/32 R, 114, 129, 35 R, 35 B, 37, 7.8; 139/166

[56] References Cited

U.S. PATENT DOCUMENTS

| | | | |
|---|---|---|---|
| 968,434 | 8/1910 | Talillefer | 36/35 R |
| 1,852,238 | 4/1932 | Gilkerson | 36/27 X |
| 2,721,400 | 10/1955 | Israel | 26/28 X |
| 3,020,933 | 2/1962 | Nagenburg, Jr. et al. | 139/166 |
| 4,030,213 | 6/1977 | Daswick | 36/30 |
| 4,316,332 | 2/1982 | Giese et al. | 36/28 |
| 4,342,158 | 8/1982 | McMahon et al. | 36/28 X |

FOREIGN PATENT DOCUMENTS

| | | | |
|---|---|---|---|
| 2460034 | 6/1976 | Fed. Rep. of Germany . | |
| 2754079 | 6/1979 | Fed. Rep. of Germany | 36/32 R |
| 2816619 | 10/1979 | Fed. Rep. of Germany . | |
| 1018215 | 10/1952 | France . | |
| 1024158 | 1/1953 | France . | |
| 1164720 | 5/1958 | France . | |
| 2448308 | 9/1980 | France | 36/28 |
| 585531 | 3/1977 | Switzerland | 36/28 |
| 1444091 | 7/1976 | United Kingdom | 36/28 |
| 2032761 | 5/1980 | United Kingdom | 36/35 B |

*Primary Examiner*—James Kee Chi

*Attorney, Agent, or Firm*—Toren, McGeady and Stanger

[57] ABSTRACT

An elastic sole for a shoe, such as a sport shoe, includes an outer sole with a profiled wearing surface and an inner sole. The inner sole forms at least one chamber. A spring member is located within the chamber and includes a plurality of elastomer spring elements and a tension rod extending through the spring elements. The tension rod is connected to abutments at opposite ends of the spring elements. One end of the tension rod is accessible on the exterior of the sole for adjusting the spring characteristic of the spring member.

30 Claims, 9 Drawing Figures

ELASTIC SOLE FOR A SHOE INCORPORATING A SPRING MEMBER

SUMMARY OF THE INVENTION

The present invention is directed to an elastic sole for a shoe, especially a sport shoe, with at least one resilient or spring component arranged between an outer sole and an inner sole of the shoe or connected to the sole made up of an outer sole and an inner sole.

Sport shoes with elastically resilient soles are known and have the purpose of providing a certain springiness due to the resiliency of the entire sole in order to absorb vibrations in the region of the heel bone and strong impact loads on Achilles tendon and thereby afford protection of various joints.

In U.S. Pat. No. 4,030,213 it is known to provide a certain spring characteristic by the use of helical springs embedded in the sole material. In such an arrangement the spring characteristic is not adjustable and, therefore, cannot be adjusted to the intended use or to the weight of the wearer. Furthermore, German Offenlegungsschrift No. 24 60 034 discloses a sport shoe having a unitary sole containing air chambers connected to one another through throttle openings. This construction, however, does not afford support of the foot at the proper location, that is, in the region of the heel bone. Moreover, the introduction of air and the adjustment to the required pressure are problematic in this construction.

Therefore, it is the primary object of the present invention to provide a support shoe which can be adjusted in a simple manner to the weight of the user for facilitating an optimum adjustment of the spring characteristic and damping effect of the shoe relative to the wearer's weight and the hardness of the running track or surface on which the shoe is to be used.

In accordance with the present invention, the spring characteristic is varied by means of an externally adjustable, mechanical spring member disposed within the sole between an outer sole and an inner sole. Advantageously, the spring member is located in the region of the heel and is incorporated into a wedge-shaped part formed in the region between the inner sole and the outer sole. By adjusting the spring member it is possible, in a simple manner, to variably prestress the spring member and thereby adjust the spring characteristic of the shoe to the weight of the user and the hardness of the track. Such an adjustment can be effected very finely since the spring member is infinitely adjustable.

The spring member can be a structural component or, advantageously, in accordance with the present invention, it can be formed of a plurality of elastomer spring elements. The spring member or the elastomer spring elements can be formed of a foamed material or of a fully elastic material. Further, it is advantageous if the elastomer spring elements are provided with hollow spaces. Preferably, the foamed elements are provided with a closed outer skin protecting the surface of the element against wear and at the same time providing an additional spring effect if gas is enclosed within the element.

In a very simple mechanical arrangement of the spring member, in accordance with the present invention, at least one tension rod is incorporated in the spring member with the rod being arranged essentially in a parallel plane with the outer sole. Each tension rod is operatively connected with at least one abutment within the sole for ensuring the safe and simple adjustment as well as an adequate fixation of the spring member within the sole. Any reduction in the mobility of the sole is avoided in a simple manner by making the tension rod a bendable elastic component or by forming the tension rod from a tension cable.

As demonstrated by the present invention, it is advantageous when the end of the tension rod within the sole is threaded in connection with a pressure disk, since such an arrangement affords a uniform transmission of the initial stressing force to the spring elements.

In accordance with the present invention, several chambers can be arranged within the sole for accommodating the spring member between the inner sole and the outer sole. The chambers can be separated from one another in the longitudinal direction or in the transverse direction of the sole. When the separating web extends in the longitudinal direction, it is possible to compensate for a malformed foot by varying the spring hardness or the spring characteristic in each of the chambers. When the web extends transversely, it is particularly advantageous if the web is arranged in the region of the heel bone and is constructed as a spring element with the tension rod extending through it so that it forms an abutment for the elastomer spring elements located within the individual chambers. Aside from the initial stress acting on the spring elements for affording adjustment to the weight of the wearer, it is also possible to arrange the spring elements with different hardness so that an especially favorable basic adjustment is afforded adapted to the anatomy of the foot.

Another feature of the invention involves the arrangement of the boundary surfaces of the chambers providing either a positive or a negative angle for the elastomer spring elements. Further, depending on the shape of the surfaces in the chambers, a progressive or regressive character can be provided for the spring member.

To avoid the generation of noise during use, material with good sliding properties can be incorporated into the region of the surface of the chambers. Such material may be a slide foil or a powder-like sliding agent, such as, talcum.

In an especially advantageous embodiment of a sport shoe, the spring member is combined as a single structural unit with the chambers and the adjusting device. As is illustrated, the structural unit forms a portion of the inner sole which is replaceably connected to the shoe. A replaceable connection of such a structural unit with the shoe can be effected by a stud connection, since such a stud connection can be made from known plastic parts. Accordingly, a cover can be arranged over the entire surface of the inner sole or only in the portion covering the spring member.

Another feature of the invention involves a tension rod with an adjusting wrench connected to it. In its at rest position, the adjusting wrench conforms to the contour of the sole and can be displaced into an adjusting position for varying the initial stress on the spring member. It is possible to lock the adjusting wrench in the at rest position as well as in the adjusting position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
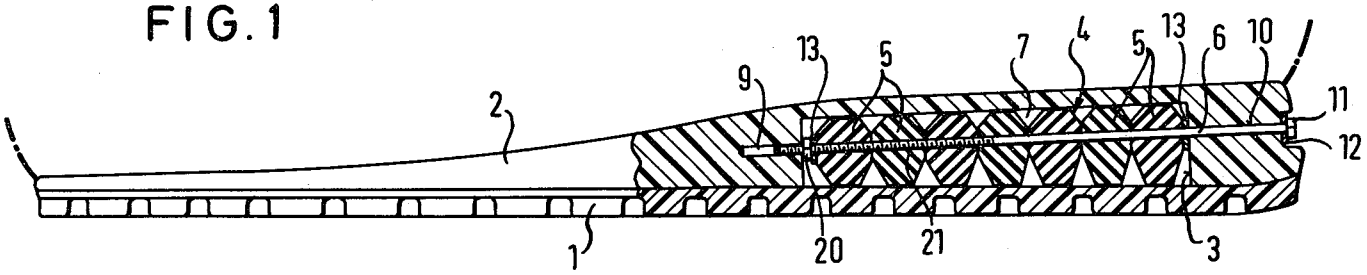
FIG. 1 is a longitudinal sectional view of the sole of a sport shoe embodying the present invention.
Figure 2:
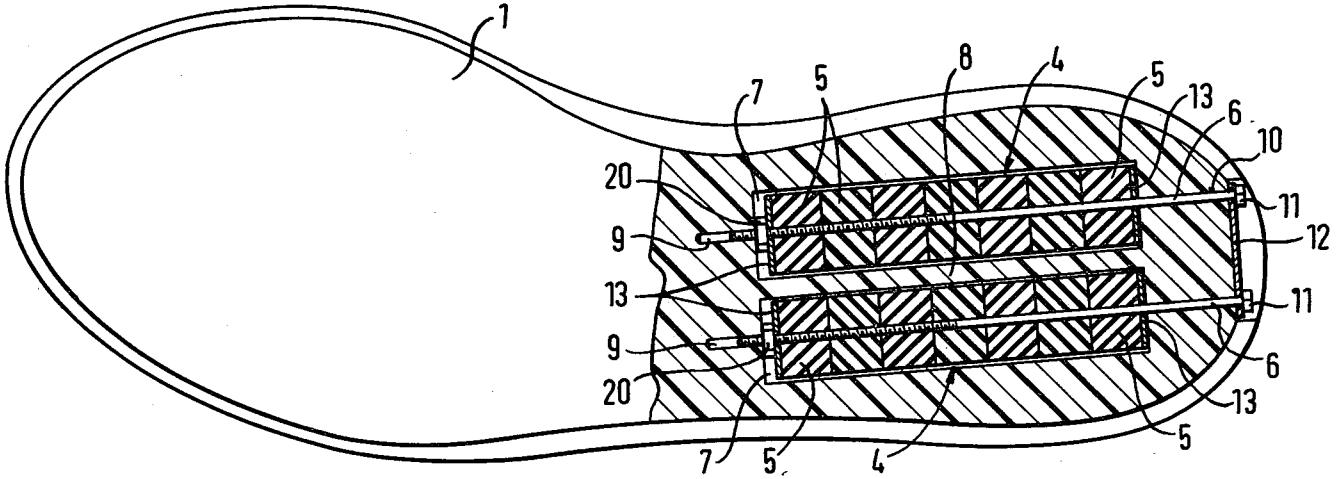
FIG. 2 is a top view, partly in section, of the sole shown in FIG. 1.

In the drawings only the sole of a sport shoe is illustrated. In FIGS. 1 and 2, an embodiment is illustrated with the sole being formed of an outer sole 1 having a profiled wearing surface and an inner sole 2 having a wedge-shaped configuration as viewed in FIG. 1 to conform to the shape of the human foot. The wedge-shaped portion of the sole is formed by the inner sole 2 and a recess in the inner sole forms a pair of chambers 7 in which a spring member 4 is positioned. The chambers 7 are separated in the longitudinal direction of the sole by a web 8. Spring member 4 is formed of two units with each unit consisting of elastomer spring elements 5, a tension rod 6, spring disks 13 and nuts 20. Before the outer sole 1 is glued or vulcanized onto the inner sole 2, the spring member is placed in the chambers 7. In each chamber 7, a number of elastomer spring elements 5 are arranged in series extending between two pressure disks 13 spaced apart in the long direction of the sole. Tension rod 6 extends through each of the elements 5 and is supported at its forward end by a bearing 9 and at its rearward end by another bearing 10. At its forward end, adjacent the center of the sole, tension rod 6 is provided with a thread 21 engaged by a nut 20 which is fixed to the disk 13. Preferably, pressure disks 13 are connected in a form-locking manner to the adjacent elastomer spring elements, that is, projections on the disks 13 engage in corresponding recesses in the spring elements 5. At the rearward end of the inner sole 2, that is the right-hand end as viewed in FIGS. 1 and 2, each tension rod 6 protrudes from the exterior of the sole and has an adjusting knob 11, which knob bears against a support bearing 12 extending across a portion of the rear end of the sole. After the inner sole has been attached, the chambers 7 containing the spring member 4 are completely enclosed and the initial stress on the elements 5 can be effected separately by means of the adjusting knobs 11 on the tension rods 6. For effecting adjustment, the knobs 11 are provided with appropriate surfaces for receiving an adjusting tool.

The series arranged spring elements 5 are supported on the left-hand or forward side of the chambers 7 by an abutment 13 and the nut 20 threaded on the tension rod 6 for transmitting force imparted to the support bearing 12. At the rear or right hand end of the chambers 7, the spring elements bear via pressure disk 13 against the rearward abutment or wall of the chamber 7. By turning the adjusting knob fixed to a tension rod 6, the tension rod or spring characteristic of the spring elements 5 can be adjusted with about 40 revolutions of the adjusting knob being required between the minimum and maximum spring characteristic. By means of the interaction of the thread 21 on the tension rod and the nut 20 the rotation of the tension rod 6 causes an axial displacement of the pressure disk 13 and, therefore, an adjustment of the spring characteristic of the spring elements 5. Since it is possible to provide a separate adjustment of the spring units located in the two chambers 7, a different spring hardness or characteristic can be provided on one side of the sole as compared to the other so that malformations or defects of the foot can be compensated. Furthermore, by constructing the spring member from individual spring elements, it is possible to use spring elements 5 having different spring characteristics. In this way, it is possible to adjust the properties of the spring member to the weight of the person wearing the shoe. It is especially advantageous to arrange the spring member directly below the heel bone. Moreover, the tension rod can be formed of glass fiber-reinforced plastics material or of some other resilient elastic material. It is also possible to use a tension cable in place of the tension rods.

Figure 3:
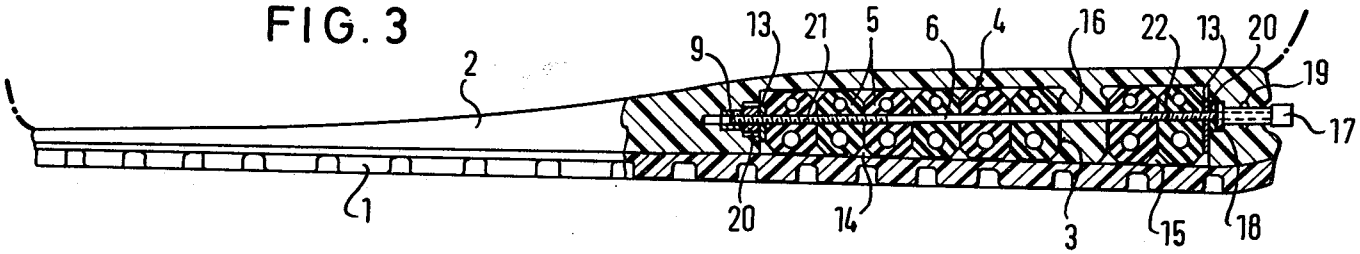
FIG. 3 is a longitudinal sectional view of another embodiment of the present invention with the sole being divided into chambers separated by a transversely extending web.
Figure 4:
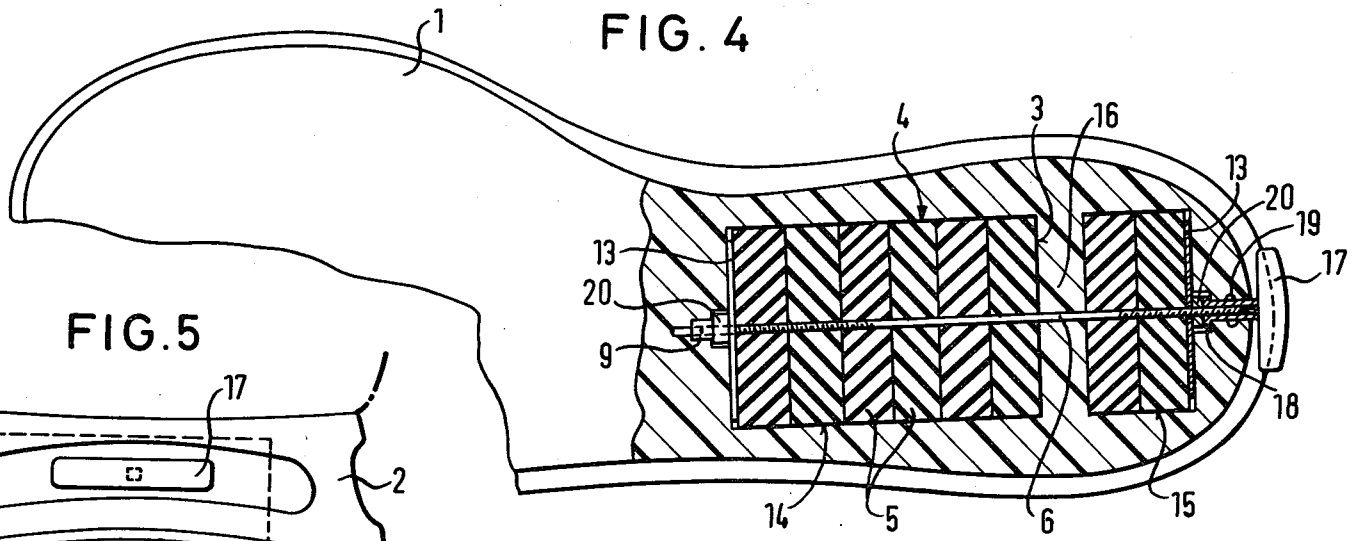
FIG. 4 is a plan view, partly in section, of the sole illustrated in FIG. 3.
Figure 5:
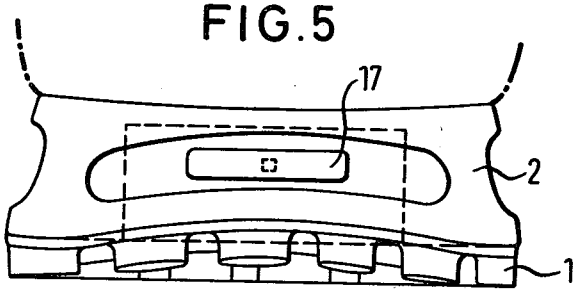
FIG. 5 is a rear end view of the sole displayed in FIGS. 3 and 4.

In the embodiment illustrated in FIGS. 3, 4 and 5, the recesses formed in the wedge-shaped portion of the inner sole 2 form a forward chamber 14 and a rearward chamber 15 for the spring member 4. As distinguished from the embodiment of FIGS. 1 and 2, web 16 extends transversely of the long direction of the sole and separates the chambers 14, 15. Transverse web 16 is formed as a spring element itself with the tension rod 6 extending through it. Further, transverse web 16 serves as an abutment 3 for the spring elements contacting the transverse web. Spring elements 5 in this embodiment differ from those illustrated in FIGS. 1 and 2 in that they have special hollow spaces filled with gas within their interior. Tension rod 6 also differs from the other embodiment because it has, in addition to the threaded portion 21 at the left-hand forward end, another threaded portion 22 at the right-hand end. Threaded portion 21 has a right-hand thread, while threaded portion 22 has a left-hand thread. A bushing 9 forms the forward bearing supporting the tension rod 6 while an adjusting wrench 17 provides the rearward turning bearing with the wrench being axially movable on the tension rod. The adjusting wrench 17 is mounted on the tension rod so that it can turn the rod. The tension rod is square at its rear end and the adjusting wrench has a corresponding square hole connectible with the end. In FIGS. 3, 4 and 5, the adjusting wrench is illustrated in the at-rest position, that is, the collar of the adjusting wrench is engaged by a locking means 18. To adjust the spring characteristic, the adjusting wrench 17 is pulled out of the illustrated position and engages the collar in locking means 19. In this position the adjusting wrench can be turned with a corresponding rotation of the tension rod for adjusting the spring characteristic of the spring elements 5. To increase the spring characteristic, a clockwise turn is performed so that the pressure disk at the opposite ends of the spring elements are moved axially. In this arrangement, the movements of the left and right pressure disks 13 are in opposite directions because the thread 21 is a right-hand thread and the thread 22 is a left-hand thread. To establish the hardest and softest adjustments of the spring characteristic, appropriate stops for the axially movable parts are arranged on the tension rod 6. Bushing 9 serves for the softest adjustment, while the end of the thread forms the stop for the hardest adjustment.

In the embodiment in FIGS. 3, 4 and 5, the outer sole 1 having the profiled wearing surface, is only glued to the bottom surface of the inner sole after the spring member has been positioned within the chambers in the inner sole. It is easily possible to connect the unit consisting of the spring member 4, the chambers 14, 15, and the adjusting device to the sole so as to be exchangeable. In such an arrangement, the unit is connected to the inner sole by a stud connection and an appropriate cover is provided over the area of the connection or over the entire sole area.

The boundary surfaces of the chambers 7 shown in FIGS. 1 and 2 or of the chambers 14, 15 illustrated in FIGS. 3 and 4 can be parallel to one another to have such appropriate positive or negative angles to effect a further change in the spring characteristic so that it becomes progressive or regressive.

The embodiment shown in FIGS. 3, 4 and 5 facilitates a very fine adjustment of the spring characteristic, since about 40 revolutions of the adjusting wrench 17 are required for going from the softest adjustment to the hardest adjustment. Changes in the spring characteristics within the individual chambers can also be varied by appropriate pitches of the threads 21, 22. Moreover, it is possible to arrange the spring member so that it is adjusted from the side of the shoe and not from the rear end of the shoe.

In general, it should be noted that the spring member is preferably arranged in the wedge-shaped portion of the inner sole so that the support is provided in the region of the center of the heel. Relative to the spring element 5, the pressure disks 13 at both ends of the chambers have a small height, approximately one-third of the height of the spring elements. It is desired that the design and arrangement of the spring member is such that the same elastomer spring element 5 can be used. It is also possible in special cases to form the spring element 5 from different materials, that is, with different spring characteristics, or with different shapes in order to achieve different supports in the region of the foot and, thus, compensate for extreme weight or foot defects of the wearer.

Figure 6A:
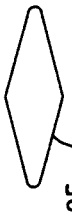
FIG. 6*a* is a plan view of another embodiment of the window illstrated in FIG. 6.
Figure 6:
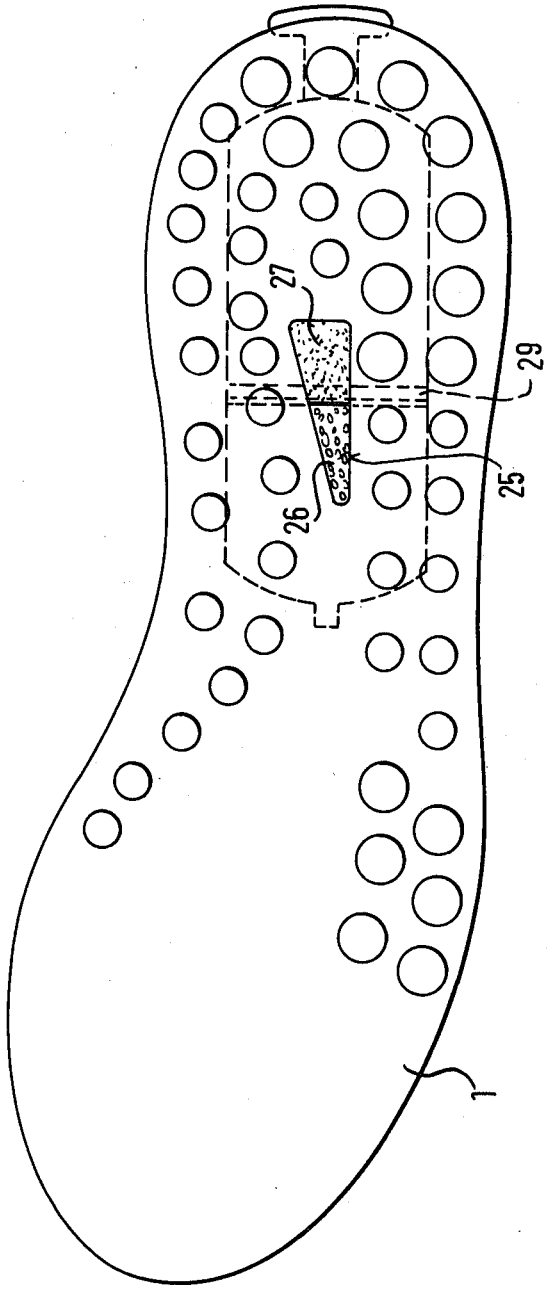
FIG. 6 is a bottom view of a further embodiment of the present invention with the sole having a transparent window for displaying an indicator member.
Figure 7:
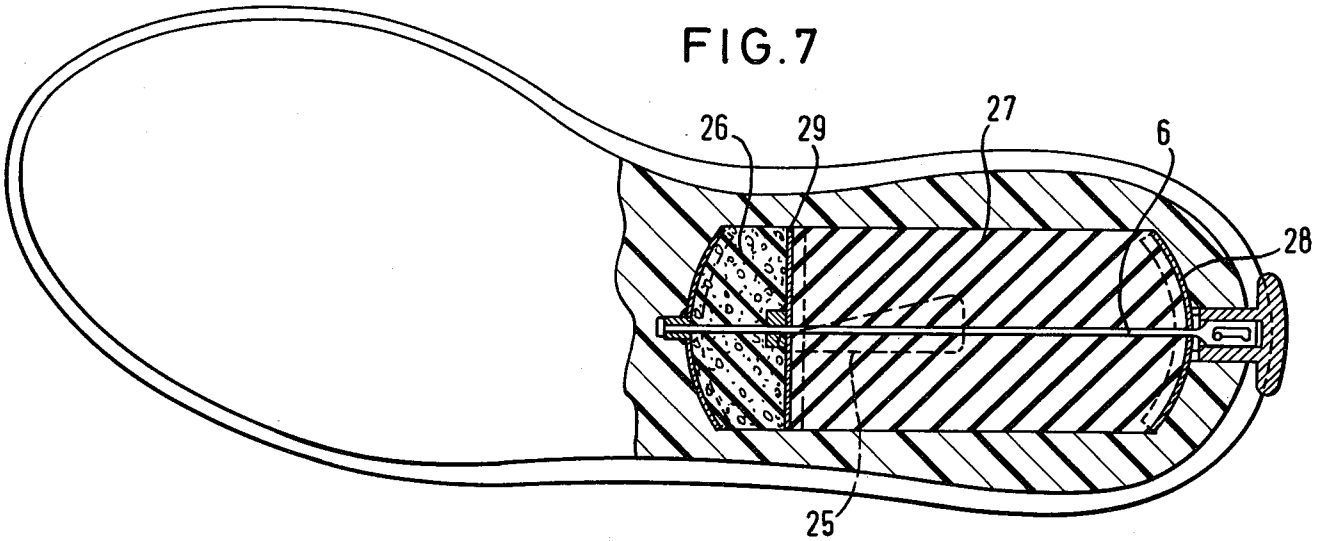
FIG. 7 is a plan view, partly in section, of the sole illustrated in FIG. 6.
Figure 8:
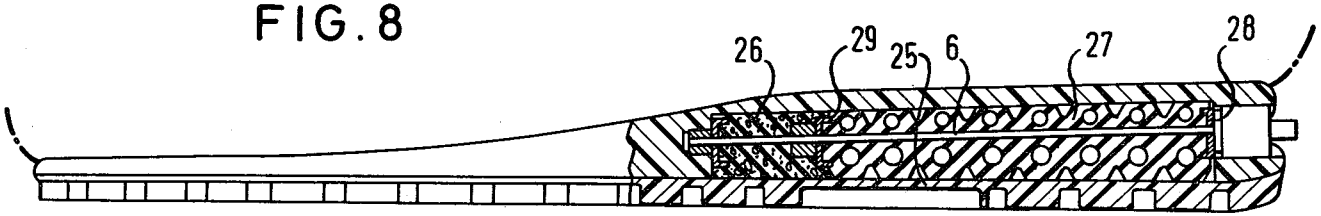
FIG. 8 is a longitudinal sectional view of the sole illustrated in FIG. 6.

In FIGS. 6, 7 and 8, another embodiment of a sole is shown wherein the stress adjustment of the spring member arranged between the outer sole and the inner sole is visible from the outside. The outer sole 1 comprises a window 25 formed by a transparent or translucent insert, or by a section of smaller thickness of an at least partially translucent outer sole. The spring member 27 prestressed by the tension rod 6 is designed in one piece and comprises a pressure disk 28 bent in the heel region and adapted to the rear outer sole contour. When the spring member 27 is prestressed, the front pressure disk 29 moves in the direction of the rear pressure disk 28. Thus, a filling member 26 preferably made of foamed plastics, correspondingly expands so that no hollow space is formed in the region of the pressure disk 29. For rendering the initial stress of the spring clearly visible through the window 25, the compensating member 26 and the spring member 27 have distinctively different colours, e.g. the compensating member 26 is white or yellow coloured and the spring member 27 is black or red coloured. The members 26 and/or 27 may also be fluorescent, whereby a signal effect is achieved which serves the safety in the dark.

The essence of the outer sole illustrated in FIG. 6 lies in the transparent or translucent window which enables a visible indication of the initial stress of the spring member. By comparing both shoes a uniform adjustment of the initial stress of the spring member of both shoes is possible. The window 25 may be formed as desired. FIG. 6 illustrates a triangular-shaped window broadening in the direction of greater initial stress. FIG. 6*a* illustrates a rhomboid window 25*a*.

While specific embodiments of the invention have been shown and described in detail to illustrate the application of the inventive principles, it will be understood that the invention may be embodied otherwise without departing from such principles.

What is claimed is:

1. A shoe, particularly for use as a sport shoe, comprising an elastic sole, at least one chamber located in said sole, and a spring member formed of an elastomer material located within said chamber, wherein the improvement comprises at least one elongated tension rod located in and extending through said chamber and disposed generally parallel to said sole, at least two abutments spaced apart in the elongated direction of said tension rod, said spring member is located between said abutments, said spring members slidably displaceable within said chamber, and an adjusting device positioned on said tension rod and operable from the exterior of said sole for varying the distance between said abutments in the elongated direction of said tension rod for adjusting said spring member.

2. A shoe, as set forth in claim 1, wherein said sole comprises an outer sole having a profiled wearing surface and an inner sole superimposed on said outer sole.

3. A shoe, as set forth in claim 1, wherein said spring member is infinitely adjustable between said abutments.

4. A shoe, as set forth in claim 2, wherein said sole having a longitudinal direction and said spring member extends in the longitudinal direction of said sole and includes at least one elastomer spring element.

5. A shoe, as set forth in claim 4, wherein a plurality of said elastomer spring elements are disposed in a series arrangement extending in the longitudinal direction of said sole.

6. A shoe, as set forth in claim 4, wherein said elastomer spring element having hollow spaces therein.

7. A shoe, as set forth in claim 4, wherein said tension rod extends through said spring elements.

8. A shoe, as set forth in claim 4, wherein said tension rod is formed as a bending-elastic member.

9. A shoe, as set forth in claim 8, wherein said bending-elastic member comprising a tension cable.

10. A shoe, as set forth in claim 5, wherein at least one of said abutments comprises a pressure disk positioned within said inner sole in contact with one end of said series of spring elements, and said tension rod being in threaded engagement with said pressure disk.

11. A shoe, as set forth in claim 4, wherein said sole is recessed and forms a plurality of said chambers therein with said spring member located within said chambers.

12. A shoe, as set forth in claim 11, wherein said chambers are located within said inner sole and said inner sole having a transverse web therein extending across the longitudinal direction of said sole and separating said chambers, said transverse web is arranged in the region of said sole for supporting the heel bone of a wearer, said transverse web comprising a spring element and forming one said abutment for said elastomer spring elements.

13. A shoe, as set forth in claim 4, wherein the opposite ends of said tension rod have oppositely threaded portions.

14. A shoe, as set forth in claim 13, wherein at least one said threaded portion has a stop at each end thereof.

15. A shoe, as set forth in claim 4, wherein a plurality of said tension rods are arranged in laterally spaced relation transversely of the longitudinal direction of said sole and said tension rods being variably adjustable so that different spring characteristics can be provided within said spring member.

16. A shoe, as set forth in claim 11, wherein said chambers having boundary surfaces extending transversely of the longitudinal direction of said sole and defining the surfaces contacted by said spring elements and said boundary surfaces forming one of a negative and positive angle for affording a variable spring characteristic for said spring member.

17. A shoe, as set forth in claim 16, wherein said boundary surfaces are formed of a material having a favorable sliding property.

18. A shoe, as set forth in claim 11, wherein said spring member and said chambers are combined to form a structural unit.

19. A shoe, as set forth in claim 18, wherein said structural unit forming a portion of said inner sole and being replaceable.

20. A shoe, as set forth in claim 4, wherein said adjusting device comprises an adjusting wrench mounted on said tension rod and being displaceable thereon between an at-rest position and an adjusting position.

21. A shoe, as set forth in claim 20, wherein said adjusting wrench is shaped to conform to the contour of said sole.

22. A shoe, as set forth in claim 20, wherein said adjusting wrench is telescopically movable on said tension rod for movement between the at-rest position and the adjusting position.

23. A shoe, as set forth in claim 20, wherein locking means are located on said tension rod for locating said adjusting wrench in the at-rest position and in the adjusting position.

24. A shoe, as set forth in claim 1, wherein said adjustable spring member comprises indicator means, the position of which within said sole corresponds to the spring characteristic of said spring member and said sole comprises a window through which the position of said indicator means is visible from the exterior of said sole.

25. A shoe, as set forth in claim 24, wherein said window comprises an insert fixed within an opening in said sole, and said insert is made of a transparent material.

26. A shoe as set forth in claim 24, wherein said window is formed by an integral portion of said sole having a reduced thickness.

27. A shoe, as set forth in claim 4, wherein said spring member and an elastomer filling member are disposed in series arrangement extending in the longitudinal direction of said sole.

28. A shoe, as set forth in claim 27, wherein said spring member and said filling member have different colours and said sole comprises a window through which the position of the colour transition is visible from the exterior of said sole.

29. A shoe, as set forth in claim 27, wherein said filling member comprises a synthetic foam material.

30. A shoe, as set forth in claim 1, wherein said abutments clamp said spring member between them and are supported on said tension rod.

* * * * *